US010519715B2

(12) United States Patent
Davis et al.

(10) Patent No.: US 10,519,715 B2
(45) Date of Patent: Dec. 31, 2019

(54) INTERMEDIATE RUNG APPARATUS FOR A LADDER

(71) Applicants: Patrick Michael Davis, St. Charles, MO (US); Jason Bodart, St. Charles, MO (US)

(72) Inventors: Patrick Michael Davis, St. Charles, MO (US); Jason Bodart, St. Charles, MO (US)

( * ) Notice: Subject to any disclaimer, the term of this patent is extended or adjusted under 35 U.S.C. 154(b) by 48 days.

(21) Appl. No.: 15/851,951

(22) Filed: Dec. 22, 2017

(65) Prior Publication Data

US 2019/0195017 A1 Jun. 27, 2019

(51) Int. Cl.
*E06C 7/48* (2006.01)
*E06C 7/08* (2006.01)

(52) U.S. Cl.
CPC ..... *E06C 7/082* (2013.01); *E06C 7/48* (2013.01)

(58) Field of Classification Search
CPC ..... E06C 7/16
USPC ..... 182/121, 122; 248/339
See application file for complete search history.

(56) References Cited

U.S. PATENT DOCUMENTS 221,780 A * 11/1879 Clark
2,376,529 A * 5/1945 Yarmolowich ..... E06C 7/16 182/121
2,453,355 A * 11/1948 Arnold ..... E06C 7/16 182/121
2,637,517 A * 5/1953 Brensike ..... E06C 7/16 182/119
2,665,952 A * 1/1954 Edwards ..... E06C 7/16 182/122
2,801,886 A * 8/1957 Peterson ..... E06C 7/16 182/121
2,941,617 A 6/1960 Stiffler
3,294,197 A * 12/1966 Kwiatkowski ..... E06C 7/16 182/120
3,710,894 A * 1/1973 O'Dell ..... E06C 7/16 182/106
5,052,515 A 10/1991 Nowlan
5,060,755 A 10/1991 Bourdages et al.
5,337,857 A 8/1994 Spalt et al.
5,836,420 A 11/1998 Marky, Jr.
5,960,905 A 10/1999 Gardner
5,975,240 A * 11/1999 O'Brien ..... E06C 7/165 182/116
D425,741 S * 5/2000 Duggan ..... D6/523
(Continued)

*Primary Examiner* — Alvin C Chin-Shue
(74) *Attorney, Agent, or Firm* — Armstrong Teasdale LLP

(57) ABSTRACT

An intermediate rung apparatus for use with a ladder includes a first hook, legs, and an intermediate rung. The first hook is configured to extend over a rung of the ladder and couple the intermediate rung apparatus to the ladder. The intermediate rung apparatus also includes legs extending from the first hook. The legs are configured to extend in a downward direction substantially parallel to vertical supports of the ladder when the intermediate rung apparatus is coupled to the ladder. The intermediate rung apparatus further includes an intermediate rung connected to the legs and configured to extend in a direction substantially parallel to the rung of the ladder when the intermediate rung apparatus is coupled to the ladder. In some embodiments, a mount may be used to support the intermediate rung apparatus and/or the ladder.

17 Claims, 8 Drawing Sheets

(56) References Cited

U.S. PATENT DOCUMENTS

| | | | | |
|---|---|---|---|---|
| 8,534,621 | B1 * | 9/2013 | Anderson | E06C 1/12 182/129 |
| 8,657,070 | B2 * | 2/2014 | O'Brien | E06C 7/165 182/120 |
| 2010/0300807 | A1 * | 12/2010 | Lindsey | E06C 1/06 182/129 |

* cited by examiner

INTERMEDIATE RUNG APPARATUS FOR A LADDER

FIELD

The field of the disclosure relates generally to apparatus for use with ladders. More particularly, this disclosure relates to an apparatus that removably connects to a ladder to provide an intermediate rung for the ladder and, in some embodiments, to facilitate transporting and storing the ladder.

BACKGROUND

Ladders include vertical supports and rungs or rungs extending between the supports. Typically, the rungs are spaced uniformly and are fixed along the vertical supports. During use, a person stands on the rungs to reach a desired height. However, the position of the rungs may not allow the person to stand in a desired position. Moreover, the ladder may be difficult to store and carry. Some ladders, i.e., stepladders, include one or more rungs and are self-supported. The stepladders are positioned on the ground and allow a person to reach a limited height provided by a few rungs. However, stepladders cannot be used with other ladders and typically are not adjustable.

Therefore, there is a need for an apparatus that provides an intermediate rung position of the ladder. There is a further need for an apparatus that facilitates the ladder being stored and/or carried.

BRIEF DESCRIPTION

In one aspect, an intermediate rung apparatus for use with a ladder includes a first hook, legs, and an intermediate rung. The ladder includes vertical supports and rungs extending between the vertical supports. The first hook is configured to extend over a rung of the ladder and couple the intermediate rung apparatus to the ladder. The intermediate rung apparatus also includes legs extending from the first hook. The legs are configured to extend in a downward direction substantially parallel to the vertical supports when the intermediate rung apparatus is coupled to the ladder. The intermediate rung apparatus further includes an intermediate rung connected to the legs and configured to extend in a direction substantially parallel to the rung when the intermediate rung apparatus is coupled to the ladder. The intermediate rung apparatus also includes at least one support for the intermediate rung. At least one of the intermediate rung and the at least one the support is configured to contact the vertical supports of the ladder when the intermediate rung apparatus is coupled to the ladder.

In another aspect, a ladder system includes a ladder and an intermediate rung apparatus. The ladder includes vertical supports and rungs extending between the vertical supports. The intermediate rung apparatus includes a hook configured to extend over at least one of the rungs of the ladder and couple the intermediate rung apparatus to the ladder. The intermediate rung apparatus includes legs extending from the hook. The legs are configured to extend in a downward direction substantially parallel to the vertical supports when the intermediate rung apparatus is coupled to the ladder. The intermediate rung apparatus also includes an intermediate rung extending from the leg. The intermediate rung is positioned between the rung and an adjacent rung of the ladder when the intermediate rung apparatus is coupled to the ladder. The intermediate rung apparatus further includes at least one support for the intermediate rung. At least one of the intermediate rung and the at least one the support is configured to contact the vertical supports of the ladder when the intermediate rung apparatus is coupled to the ladder.

BRIEF DESCRIPTION OF THE DRAWINGS

Corresponding reference characters indicate corresponding parts throughout the several views of the drawings.

DETAILED DESCRIPTION

Figure 1:
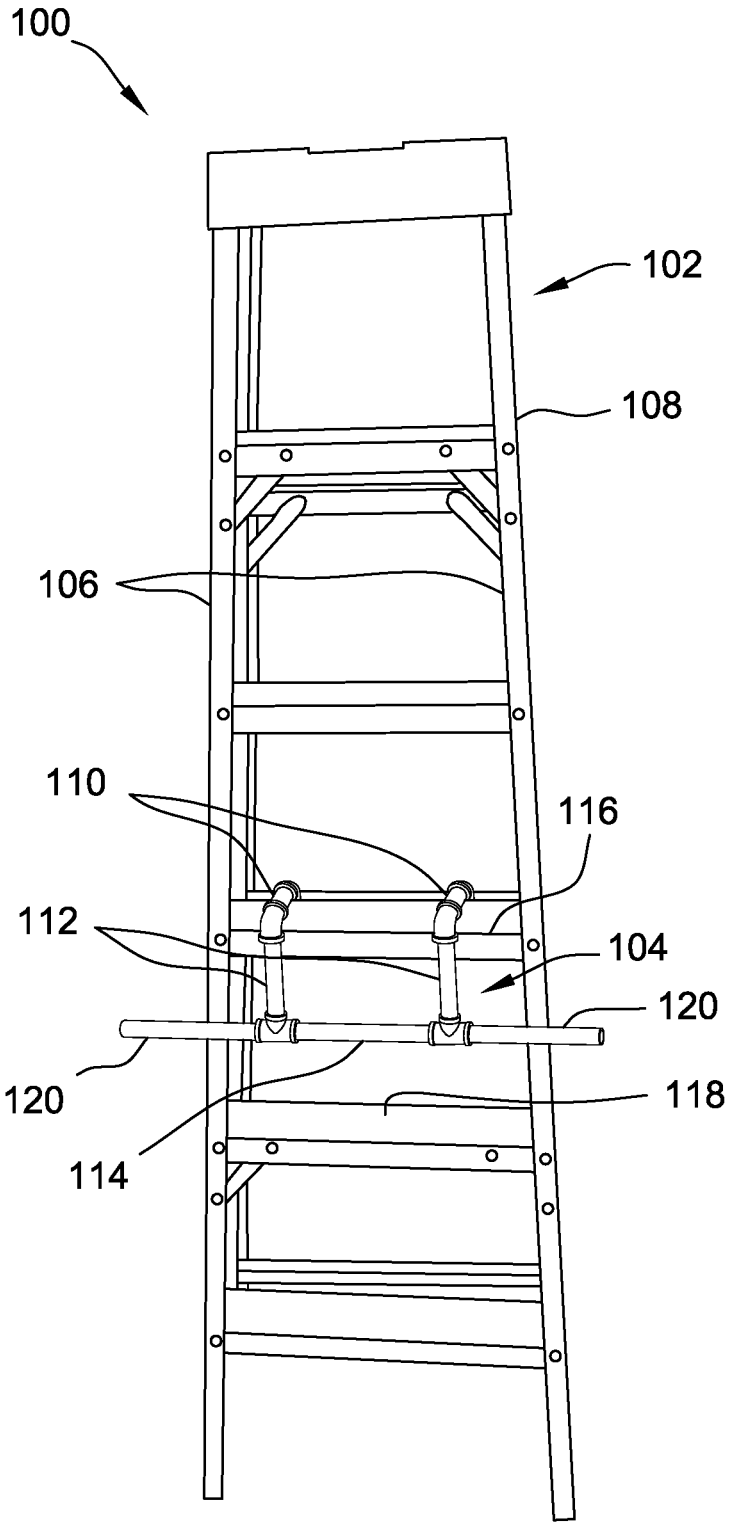
FIG. 1 is a perspective view of one embodiment of a ladder system including an intermediate rung apparatus.

Referring now to the drawings and in particular to FIG. 1, one embodiment of a ladder system is designated in its entirety by the reference number 100. FIG. 1 illustrates a particular embodiment of the ladder system 100 and, in other embodiments, the ladder system 100 may have different configurations without departing from some aspects of the invention. The ladder system 100 includes a ladder 102 and an intermediate rung apparatus 104. The ladder 102 includes vertical supports 106 and rungs 108. The rungs 108 extend perpendicular to and horizontally between the vertical supports 106 when the ladder 102 is in an upright position. All references to directions, such as vertical and horizontal, refer to the orientation of the ladder system 100 shown in FIG. 1. The ladder 102 is configured to rest on a surface and extend upward to allow a person to climb to an elevated position. In embodiments, the ladder system 100 may include any ladder 102 that enables the ladder system 100 to function as described. For example, in some embodiments, the ladder 102 may be an A-frame ladder. In further embodiments, the ladder 102 may be adjustable.

The intermediate rung apparatus 104 includes upper hooks 110, legs 112, and an intermediate rung 114. The upper hooks 110 are configured to extend over any rung 108 of the ladder 102 and couple the intermediate rung apparatus 104 to the ladder. In the illustrated embodiment, the upper hooks 110 are connected to a first step 116 of the ladder 102. Two legs 112 extend from the upper hook 110 in a vertical direction, i.e., a direction substantially parallel to the vertical supports, when the intermediate rung apparatus is coupled to the ladder 102. The intermediate rung 114 extends between the legs 112 in a horizontal direction, i.e., in a direction substantially parallel to the rungs 108, when the intermediate rung apparatus is coupled to the ladder 102. The intermediate rung apparatus 104 also includes supports 120 for the intermediate rung 114. The supports 120 are configured to contact the vertical supports 106 of the ladder 102 when the intermediate rung apparatus 104 is coupled to the ladder. In some embodiments, the supports 120 are integrally formed with the intermediate rung 114. In the example embodiment, the supports 120 extend from the legs 112 on opposite sides of the intermediate rung 114. Accordingly, the supports 120 provide stability to the intermediate rung apparatus 104.

The intermediate rung 114 is positioned between the first rung 116 and a second rung 118 when the intermediate rung apparatus 104 is coupled to the ladder 102. The second rung 118 is below the first rung 116. Accordingly, the intermediate rung 114 provides an optional rung between any fixed rungs 108 on the ladder 102 and increases the number of positions for a person standing on the ladder. In the illustrated embodiment, the intermediate rung 114 is positioned approximately halfway between the first rung 116 and the second rung 118. In some embodiments, the position of the intermediate rung 114 may be adjustable. For examples, in some embodiments, the legs 112 may be retractable and or telescoping. In further embodiments, the intermediate rung 114 may be removably coupled to the legs 112 at different positions.

In the illustrated embodiment, the intermediate rung 114 has a size that allows a person to stand on the intermediate rung. In addition, the length of the intermediate rung 114 enables the upper hooks 110 and the legs 112 to be positioned between the vertical supports 106 when the intermediate rung apparatus 104 is coupled to the ladder 102. For example, in the illustrated embodiment, the intermediate rung 114 has a length that is at least half of the length of the rungs 108. In some embodiments, the intermediate rung 114 is adjustable in a direction substantially parallel to the rungs 108 to allow the intermediate rung apparatus 104 to be used with ladders 102 having different widths between the vertical supports 106. In other embodiments, the intermediate rung 114 may have any length that enables the intermediate rung 114 to function as described.

In addition, the upper hooks 110 are configured to couple to the vertical supports 106 such that the intermediate rung apparatus 104 extends along a side of the ladder 102. Specifically, the intermediate rung 114 extends along and is spaced from the respective vertical support 106 when the ladder 102 is in a horizontal position and the intermediate rung apparatus 104 is coupled to the vertical support. Accordingly, the intermediate rung apparatus 104 facilitates carrying the ladder 102. For example, the intermediate rung apparatus 104 can provide a handle for a user to carry the ladder 102. In other embodiments, the intermediate rung apparatus 104 may be coupled to the ladder 102 in any manner that enables the intermediate rung apparatus 104 to function as described. For example, the intermediate rung apparatus 104 may include straps, clamps, fasteners, and/or any other attachment component.

In some embodiments, the intermediate rung apparatus 104 may be used to hold equipment and materials. For example, cords and devices may be hung from the hooks 110 and/or the intermediate rung 114 when the intermediate rung apparatus 104 is coupled to the ladder 102.

Figure 2:
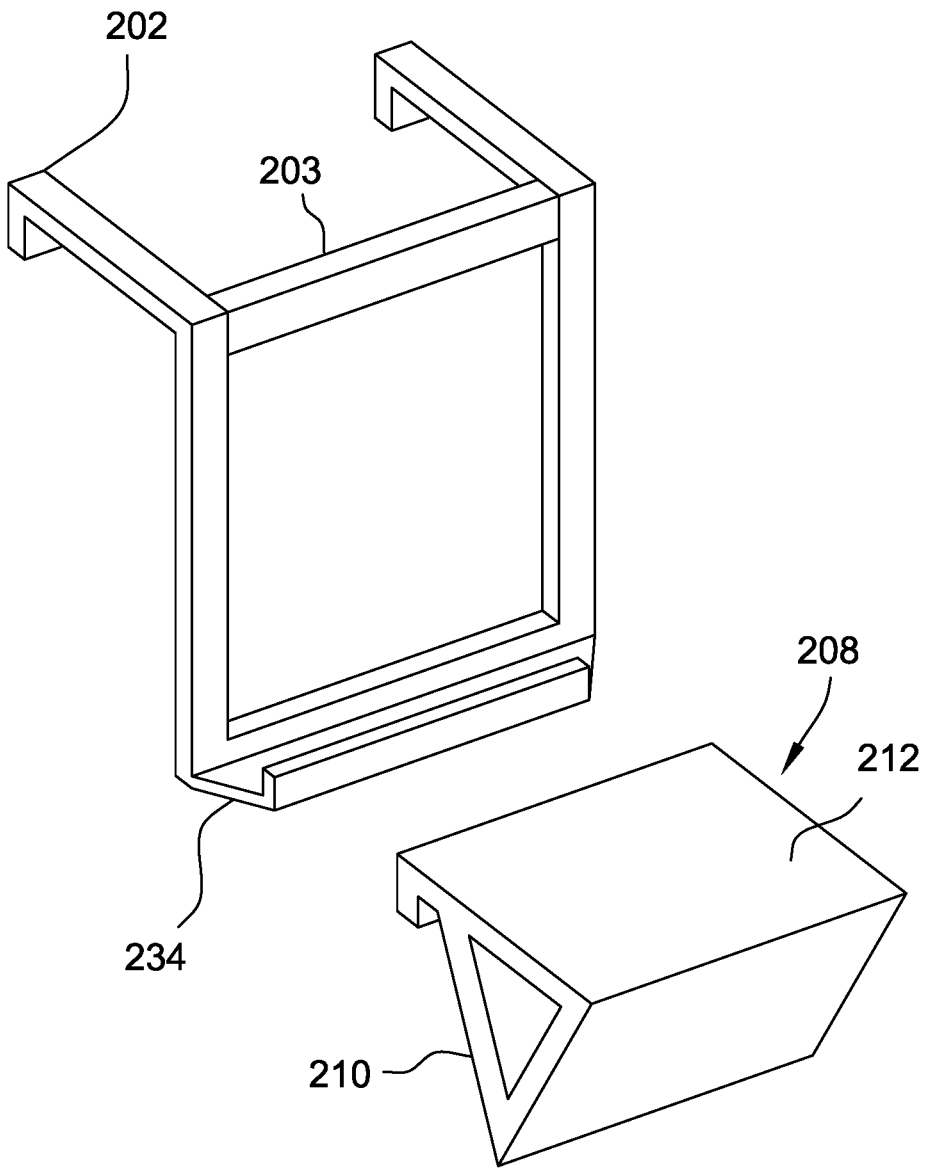
FIG. 2 is an exploded view of an embodiment of an intermediate rung apparatus for use with the ladder system shown in FIG. 1.
Figure 3:
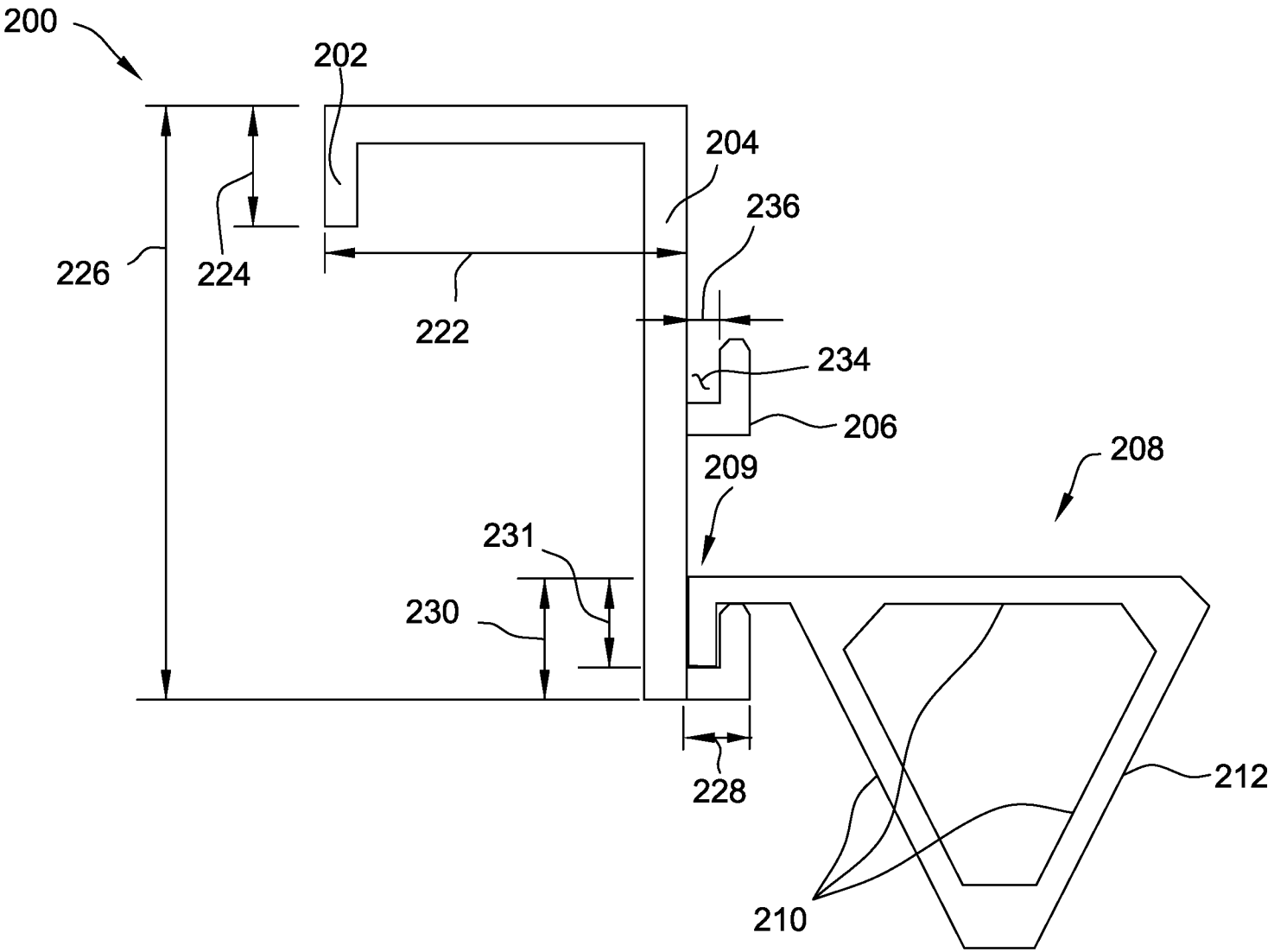
FIG. 3 is sectional side view of an embodiment of the intermediate rung apparatus shown in FIG. 2.

With reference to FIGS. 2 and 3, another embodiment of an intermediate rung apparatus is designated in its entirety by the reference number 200. The intermediate rung apparatus 200 includes a first or upper hook 202, two legs 204, at least one second or lower hook 206, and an intermediate rung 208. The legs 204 extend downward from the first hook 202. The second hook 206 extends from an end of the legs 204 opposite the first hook. The first hook 202 is configured to extend over the rung 108 (shown in FIG. 1) of the ladder 102 (shown in Fig.) and removably couple the intermediate rung apparatus 200 to the ladder. In other embodiments, the intermediate rung apparatus 200 may have any configuration that enables the intermediate rung apparatus 200 to function as described. For example, in some embodiments, the leg 204 may extend upward from the first hook 202.

A brace 203 extends between the legs 204 and the first hook 202. The brace 203 may provide support to the intermediate rung apparatus 200 to facilitate carrying the apparatus 200 and positioning objects such as a chord on the apparatus 200. In other embodiments, the intermediate rung apparatus 200 may include any braces that enable the intermediate rung apparatus 200 to function as described.

In the illustrated embodiment, the intermediate rung apparatus 200 includes a plurality of second hooks 206 providing a plurality of positions for the intermediate rung 208. In some embodiments, the second hooks 206 may be removably coupled to the leg 204 such that a single second hook 206 may be positioned in multiple positions. In some embodiments, the optional positions of the second hooks 206 may be evenly spaced along the length 228 of the leg 204. For example, the positions may be spaced apart approximately 3.5 inches (in.). In other embodiments, the second hooks 206 may be coupled to the leg 204 in any manner that enables the intermediate rung apparatus 200 to function as described.

The intermediate rung 208 may be integrally formed as a single piece. The intermediate rung 208 is configured to removably couple to the second hooks 206. For example, the intermediate rung 208 includes at least one hook 209 that engages the second hook 206. Accordingly, the intermediate rung 208 may be selectively positioned at each position defined by the second hooks 206. In other embodiments, the intermediate rung 208 may be coupled to the leg 204 in any manner that enables the intermediate rung apparatus 200 to function as described. For example, in some embodiments, the intermediate rung 208 may be integrally formed with or permanently attached to the leg 204. In further embodiments, the intermediate rung 208 may be connected to the leg 204 by a hinge.

In this embodiment, the intermediate rung 208 includes a plurality of supports 210 defining a hollow frame. The supports 210 may be integrally formed as a single piece. Each end of supports 210 forms a triangle and the frame has a generally prismatic shape. Accordingly, the intermediate rung 208 is substantially hollow and is light-weight in comparison to rungs including solid frames. In some embodiments, the intermediate rung 208 may include a platform and/or surface 212 to facilitate a user standing on the intermediate rung 208. In the illustrated embodiment, the supports 210 have a thickness of approximately 0.3 in. In some embodiments, the thickness of the supports 210 may be adjusted to provide substantial structural support. For example, in some embodiments, the thickness may be greater or less than 0.3 in. In other embodiments, the intermediate rung 208 may include any supports 210 that enable the intermediate rung apparatus 104 to function as described.

Referring to FIGS. 1-3, the first hook 202 is configured to extend over the first rung 116 of the ladder 102 such that the intermediate rung 208 is positioned between rungs 108, such as the first rung 116 and the second rung 118. The intermediate rung apparatus 200 may be positioned on any rung 108 of the ladder 102. The supports 210 are configured to extend parallel to vertical supports 106 of the ladder 102 such that the vertical supports provide support to the intermediate rung 208. In some embodiments, the size of the intermediate rung 208 is adjustable to facilitate the intermediate rung 208 connecting to the ladder 102.

The first hook 202 has a length 222 and a height 224. The length 222 and the height 224 enable the first hook 202 to extend over the rungs 108 and secure the intermediate rung apparatus 200 to the ladder 102. For example, in some embodiments, the length 222 is at least about 1 inches (in.) or in a range about 2 in. to about 6 in. In some embodiments, the height 224 is about 0.5 in. to about 12 in. or about 1 in. to about 2 in. In the illustrated embodiment, the height 224 is approximately 1.5 in. and the length 222 is approximately 4 in. In alternative embodiments, the first hook 202 is any size that enables the intermediate rung apparatus 200 to operate as described.

The leg 204 has a length 226 that enables the intermediate rung 208 to be positioned at one or more positions between the first rung 116 and the second rung 118. For example, in some embodiments, the length 226 is at least about 1 in. or in a range of about 4 in. to about 12 in. In the illustrated embodiment, the length 226 is approximately 7 in. In alternative embodiments, the leg 204 has any length 226 that enables the intermediate rung apparatus 200 to operate as described.

The second hook 206 has a length 228 that enables the second hook to couple to the leg 204 and receive the intermediate rung 208. For example, in some embodiments, the length 228 is in a range of about 0.5 in. to about 6 in. In the illustrated embodiment, the length 228 is approximately 1 in. In alternative embodiments, the second hook 206 has any length 228 that enables the intermediate rung apparatus 200 to operate as described.

In some embodiments, at least a portion of the intermediate rung apparatus 200 may be flexible to facilitate the intermediate rung apparatus 200 coupling to the ladder 102. For example, in some embodiments, a joint between the first hook 202 and the leg 204 may be flexible to allow the first hook to extend parallel to the rung 108 when the first hook is coupled to the rung.

In this embodiment, the hooks 206, 209 have similar dimensions. Accordingly, the hooks 206, 209 are modular and the cost to assemble the intermediate rung apparatus 200 is reduced. Moreover, the size and shape of the hooks 206, 209 facilitate engagement between the hooks. For example, in the illustrated embodiment, the hooks 206, 209 may have a height 230 of approximately 2 in. or greater and a depth 231 of approximately 1 in. or greater. In addition, the hook 206, 209 may define a cavity 234 having a width 236, for example, of 0.4 in. or greater. The hooks 206, 209 have, for example, a thickness of approximately 0.3 in. In other embodiments, the intermediate rung apparatus 200 may have any hooks 206, 209 that enable the intermediate rung apparatus to operate as described.

Figure 4:
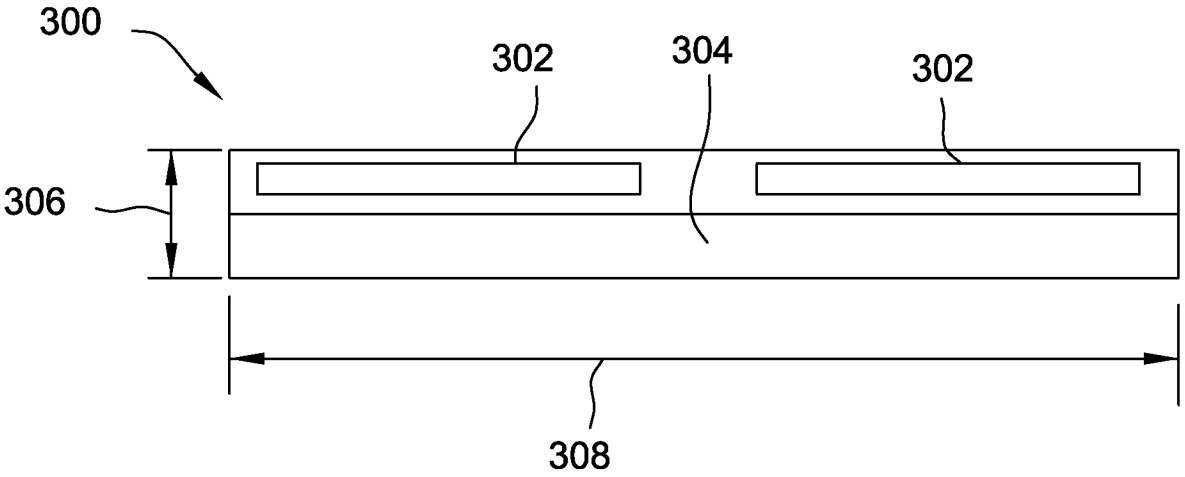
FIG. 4 is a front view of a mount for storage of the ladder system shown in FIG. 1 and the intermediate rung apparatus shown in FIG. 2.
Figure 5:
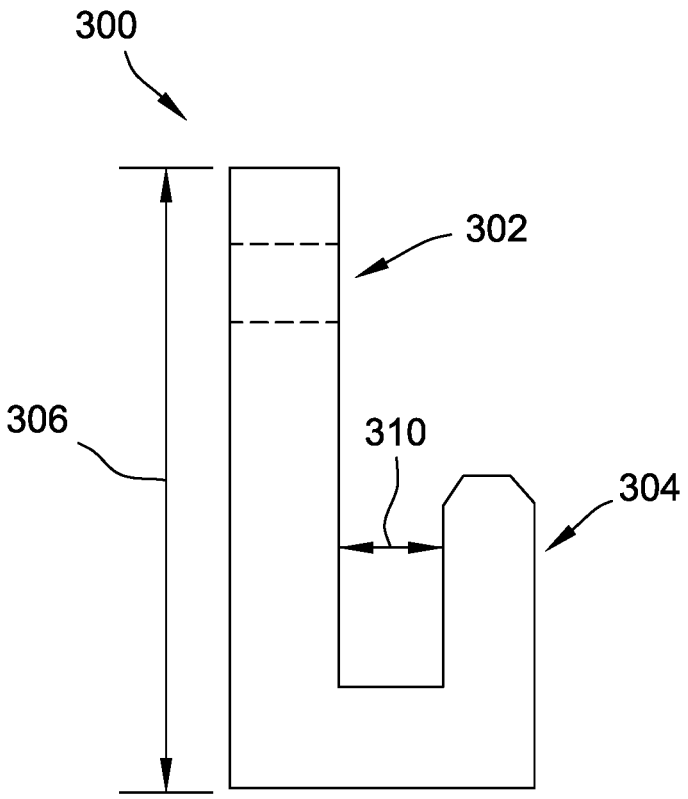
FIG. 5 is a sectional side view of the mount shown in FIG. 4.

FIGS. 3 and 4 show a mount 300 for use with the intermediate rung apparatus 104 and/or the intermediate rung apparatus 200. The mount 300 is configured to attach to a wall and/or other structure and support the intermediate rung apparatus 104, the intermediate rung apparatus 200, and/or the ladder 102. The mount 300 includes slots, broadly openings, 302 for receiving fasteners to attach the mount to the structure. In other embodiments, the mount 300 may be attached to a structure in any manner that enables the mount to function as described.

With reference to FIGS. 1-5, the mount 300 includes hooks 304 that are configured to receive the hook 209 of the intermediate rung 208 and/or the second hook 206. Accordingly, the intermediate rung apparatus 104 and the intermediate rung apparatus 200 may be coupled to the mount 300 and configured to receive the ladder 102. For example, the intermediate rung apparatus 104 may be positioned on the mount 300 such that the intermediate rung apparatus 104 is inverted and the hook 209 is configured to receive a vertical support 106 and/or the rungs 108 of the ladder 102. Alternatively, the intermediate rung apparatus 200 may be positioned on the mount such that the second hooks 206 are positioned in the hooks 304. When the intermediate rung apparatus 200 is positioned on the mount 300, the first hook 202 is configured to receive the rungs 108 of the ladder 102. In other embodiments, the intermediate rung apparatus 104, the ladder 102, and/or the intermediate rung apparatus 200 may be coupled to the mount 300 in any manner that enables the mount 300 to function as described. For example, in some embodiments, the mount 300 may be configured to receive a plurality of the intermediate rung apparatus 104 and/or the intermediate rung apparatus 200 and the intermediate rung apparatus may be configured to support the ladder 102 at multiple points along the length of the ladder 102.

The mount 300 has a height 306 and a length 308. For example, in some embodiments, the height 306 is in a range of about 0.5 in. to about 24 in. or about 1 in. to about 6 in. In some embodiments, the length 308 is at least about 6 in. or in a range of about 12 in. to about 24 in. In the illustrated embodiment, the mount 300 has a height 306 of approximately 2 in. and a length 308 of approximately 18 in. In other embodiments, the mount 300 has any height 306 and length 308 that enables the mount 300 to function as described.

The hooks 304 are sized to receive the hooks 206, 209. For example, in some embodiments, the hook 304 has a height of approximately 2 in. or greater and a depth of approximately 1 in. or greater. In addition, the hooks 304 define a cavity 310 having a width of 0.4 in. or greater. The hooks 304 may have, for example, a thickness of approximately 0.3 in. In other embodiments, the mount 300 may have any hook(s) 304 that enables the mount to operate as described.

Figure 6:
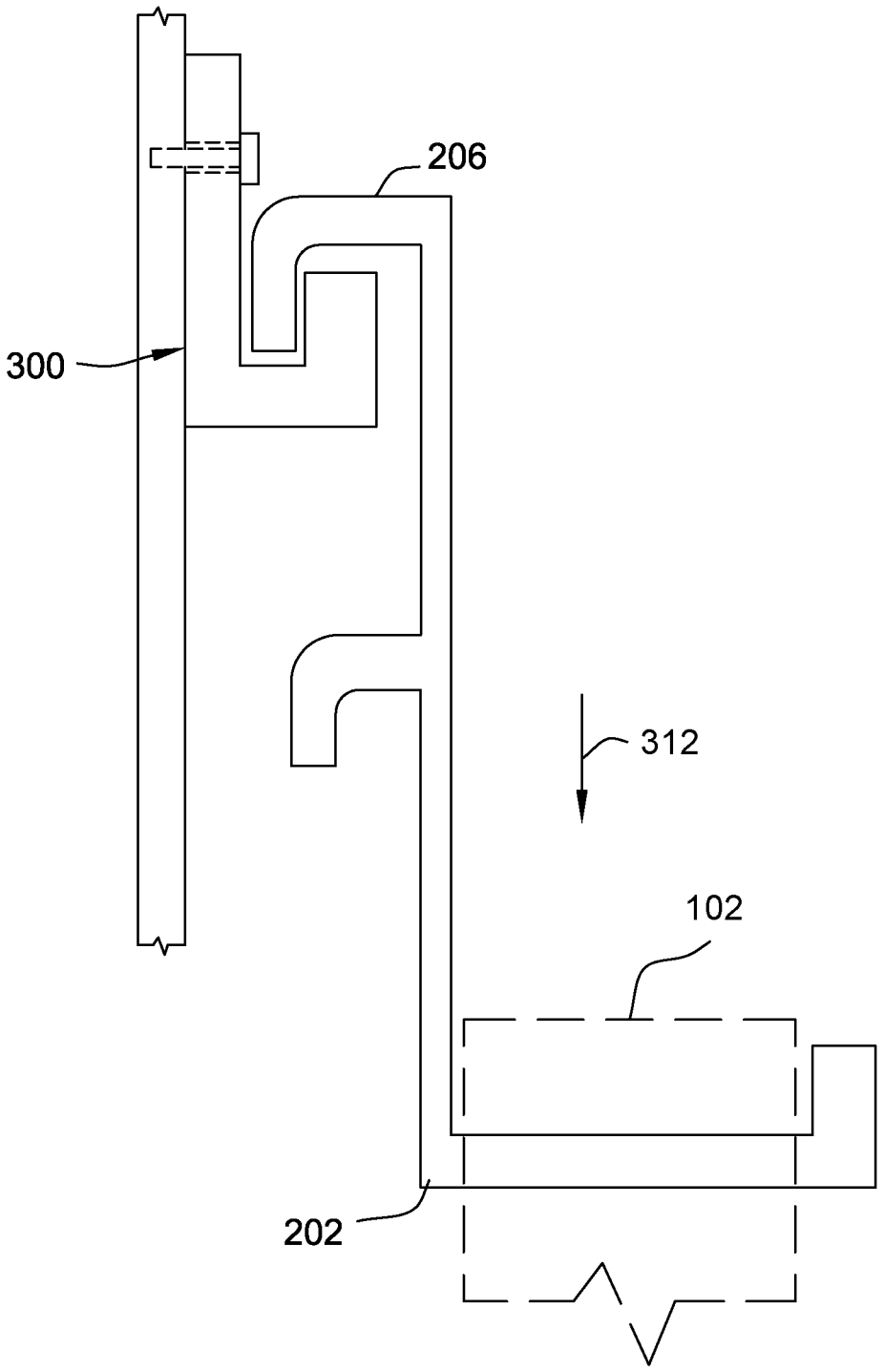
FIG. 6 is a sectional side view of a portion of the intermediate rung apparatus shown in FIG. 2 and the mount shown in FIG. 4.

FIG. 6 is a sectional side view of the mount 300 supporting the intermediate rung apparatus 200. The hook 206 of the intermediate rung apparatus 200 is positioned in the hook 304 of the mount 300. The mount 300 supports the intermediate rung apparatus 200 and counters the downward gravitational force 312 due to the weight of the intermediate rung apparatus 200. In some embodiments, the intermediate rung apparatus 200 may receive the ladder 102 and the mount 300 may support the intermediate rung apparatus 200 and the ladder 102.

Figure 7:
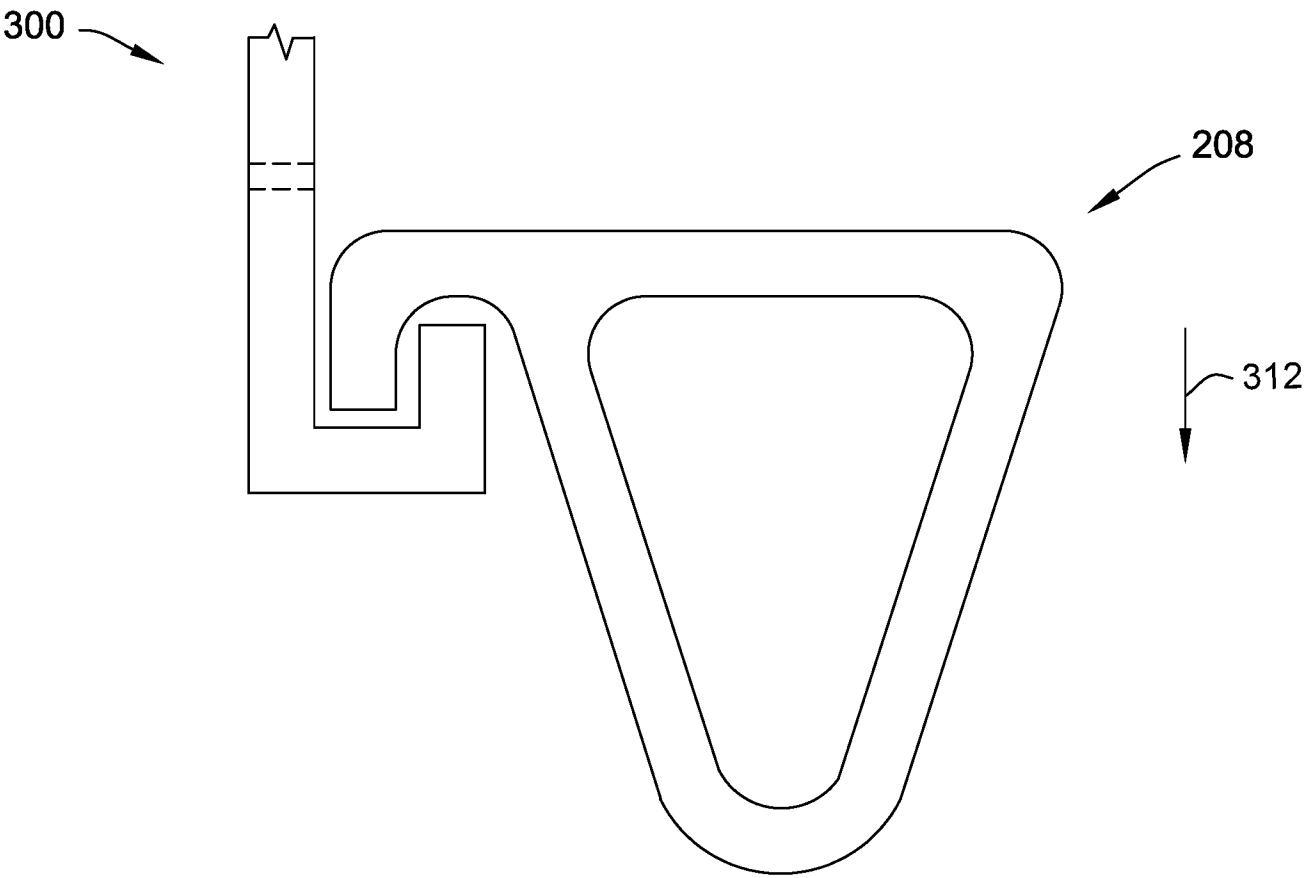
FIG. 7 is a sectional side view of an intermediate rung of the intermediate rung apparatus shown in FIG. 2 and the mount shown in FIG. 4.

FIG. 7 is a sectional side view of the mount 300 supporting the intermediate rung 208 of the intermediate rung apparatus 200. The intermediate rung 208 is positioned on the hook 304 of the mount 300 such that the mount 300 supports the intermediate rung 208. Specifically, the hook 206 is positioned in the hook 304 of the mount 300 and the mount 300 counters the downward gravitational force 312 due to the weight of the intermediate rung 208. In other embodiments, the intermediate rung 208 may be positioned on the mount 300 in any suitable manner.

Figure 8:
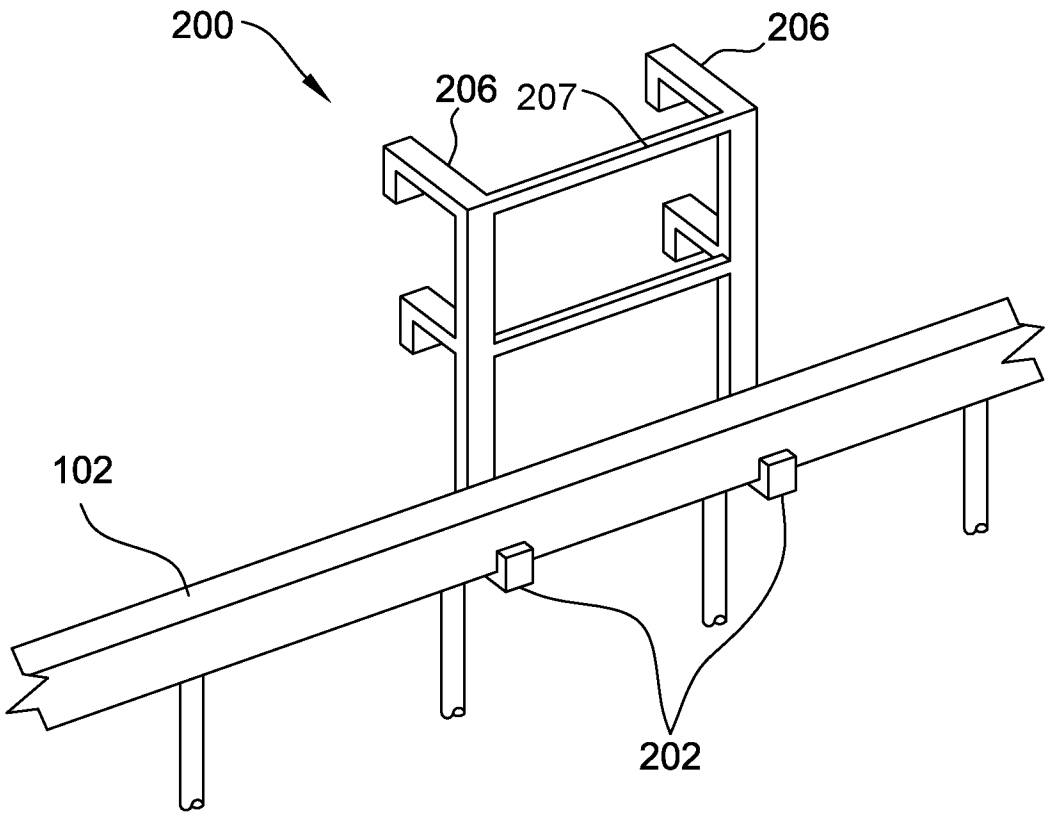
FIG. 8 is a perspective view of the intermediate rung apparatus shown in FIG. 2 and the ladder shown in FIG. 1.

FIG. 8 is a perspective view of the ladder 102 positioned in the hooks 202 of the intermediate rung apparatus 200. The intermediate rung apparatus 200 is inverted and the ladder 102 is positioned on the intermediate rung apparatus 200. Accordingly, the intermediate rung apparatus 200 may be used to transport the ladder 102. Specifically, the intermediate rung apparatus 200 may provide a handle 207 and the ladder 102 may be positioned on the hooks 206 of the intermediate rung apparatus 200. In other embodiments, the ladder 102 may be positioned on the intermediate rung apparatus 200 in any suitable manner.

The intermediate rung apparatus described above allow adjustment of a ladder and facilitate storing and transporting the ladder. For example, embodiments of the apparatus may be removably connected to a ladder to provide an intermediate rung positioned between rungs of the ladder. In addition, the apparatus may be used to mount the ladder on a wall. Also, the intermediate rung apparatus may provide a removable handle to facilitate transporting the ladder. The apparatus is light-weight and simple to assemble. In addition, the apparatus may be coupled to and removed from the ladder without the use of tools. Moreover, in some embodiments, the apparatus may be adjustable to allow the apparatus to be used with different ladders and/or increase the number of rung positions for the ladder.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description and shown in the accompanying drawings shall be interpreted as illustrative and not in a limiting sense. Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An intermediate rung apparatus for use with a ladder, the ladder including vertical supports and rungs extending between the vertical supports, said intermediate rung apparatus comprising:

a first hook and second hook configured to extend over a rung of the ladder and couple the intermediate rung apparatus to the ladder;

a leg extending from each of the first and second hook, wherein the legs are configured to extend downward in a direction substantially parallel to the vertical supports when the intermediate rung apparatus is coupled to the ladder;

a plurality of second hooks extending from each leg and defining a plurality of positions vertically spaced along the legs;

an intermediate rung removably connected to and extending between the legs, wherein the intermediate rung is positioned between the rung and an adjacent rung of the ladder when the intermediate rung apparatus is coupled to the ladder, wherein the intermediate rung is removably coupled to the second hooks at each position defined by the second hooks; and at least one support for the intermediate rung, wherein at least one of the intermediate rung and the at least one the support is configured to contact the vertical supports of the ladder when the intermediate rung apparatus is coupled to the ladder.

2. The intermediate rung apparatus of claim 1, wherein the rungs of the ladder comprise a first rung, at least one of the second hooks being positioned between the first rung of the ladder and a second rung of the ladder when the intermediate rung apparatus is coupled to the ladder.

3. The intermediate rung apparatus of claim 2 further comprising a wall mount configured to receive at least one of the second hooks and support the ladder.

4. The intermediate rung apparatus of claim 1, wherein the first hook is configured to couple to one of the vertical supports and facilitate transporting the ladder.

5. The intermediate rung apparatus of claim 1, wherein the rungs of the ladder comprise a first rung, the intermediate rung being positioned halfway between the first rung and a second rung when the intermediate rung apparatus is coupled to the ladder.

6. The intermediate rung apparatus of claim 1, wherein the position of the intermediate rung is adjustable relative to the rung of the ladder.

7. The intermediate rung apparatus of claim 1, wherein the at least one support comprises a plurality of the supports for the intermediate rung, wherein the supports are configured to contact the vertical supports when the intermediate rung apparatus is coupled to the ladder.

8. The intermediate rung apparatus of claim 7, wherein the supports define a hollow frame for the intermediate rung.

9. The intermediate rung apparatus of claim 8, wherein the frame has a substantially prismatic shape.

10. A ladder system comprising:

a ladder comprising:

vertical supports; and rungs extending between the vertical supports;

an intermediate rung apparatus for use with the ladder, said intermediate rung apparatus comprising:

a first hook and second hook configured to extend over at least one of the rungs of the ladder and couple the intermediate rung apparatus to the ladder;

a leg extending from each of the first and second hook, wherein the legs are configured to extend in a direction substantially parallel to the vertical supports when the intermediate rung apparatus is coupled to the ladder;

a plurality of second hooks extending from each leg and defining a plurality of positions vertically spaced along the legs;

an intermediate rung extending between the legs, the intermediate rung being positioned between the rung and an adjacent rung of the ladder when the intermediate rung apparatus is coupled to the ladder, wherein the intermediate rung is removably coupled to the second hooks at each position defined by the second hooks; and at least one support for the intermediate rung, wherein at least one of the intermediate rung and the at least one the support is configured to contact the vertical supports of the ladder when the intermediate rung apparatus is coupled to the ladder.

11. The ladder system of claim 10, wherein at least one of the second hooks is positioned between the rung and an adjacent rung of the ladder when the intermediate rung apparatus is coupled to the ladder.

12. The ladder system of claim 11 further comprising a wall mount configured to receive at least one of the second hooks and support the ladder.

13. The ladder system of claim 10, wherein the first hook is further configured to couple to one of the vertical supports and facilitate transporting the ladder.

14. The ladder system of claim 10, wherein the intermediate rung is positioned halfway between the rung and an adjacent rung of the ladder when the intermediate rung apparatus is coupled to the ladder.

15. The ladder system of claim 10, wherein the position of the intermediate rung is adjustable relative to the rung and an adjacent rung of the ladder.

16. The ladder system of claim 10, wherein the at least one support comprises a plurality of supports, wherein each support is configured to extend along a respective vertical support of the ladder.

17. The ladder system of claim 10, wherein the at least one support comprises a plurality of supports extending from the legs in a direction substantially parallel to the rung, wherein the supports are configured to contact the vertical supports when the intermediate rung apparatus is coupled to the ladder.

* * * * *